United States Patent [19]

Mailänder

[11] Patent Number: 4,774,883

[45] Date of Patent: Oct. 4, 1988

[54] SINGLE-COLOR OR MULTICOLOR OFFSET PRINTER WITH MOVABLE MACHINE GROUPS

[75] Inventor: Udo Mailänder, Bietigheim, Fed. Rep. of Germany

[73] Assignee: J. G. Mailänder GmbH & Co., Bietigheim, Fed. Rep. of Germany

[21] Appl. No.: 134,573

[22] Filed: Dec. 16, 1987

Related U.S. Application Data

[63] Continuation of Ser. No. 811,941, Dec. 20, 1985, abandoned.

[30] Foreign Application Priority Data

Dec. 20, 1984 [DE] Fed. Rep. of Germany ..... 3446619

[51] Int. Cl.[4] ..... B41F 7/10; B41F 7/16

[52] U.S. Cl. ..... 101/137; 101/183; 101/247; 101/352; 101/138

[58] Field of Search ..... 101/136, 137, 138, 140, 101/142, 143, 144, 145, 178, 177, 179, 180, 181, 182, 183, 184, 185, 247, 351, 352

[56] References Cited

U.S. PATENT DOCUMENTS

| | | | |
|---|---|---|---|
| 2,012,245 | 8/1935 | Meisel | 101/178 |
| 2,149,028 | 2/1939 | Meisel | 101/181 |
| 2,557,381 | 6/1951 | Huebner | 101/184 X |
| 4,449,450 | 5/1984 | Barney et al. | 101/183 |

FOREIGN PATENT DOCUMENTS

| | | | |
|---|---|---|---|
| 1169959 | 12/1964 | Fed. Rep. of Germany . | |
| 2421209 | 11/1974 | Fed. Rep. of Germany | 101/178 |
| 2754676 | 6/1978 | Fed. Rep. of Germany | 101/178 |
| 7718008 | 6/1978 | Fed. Rep. of Germany . | |
| 3010244 | 11/1980 | Fed. Rep. of Germany . | |
| 952307 | 3/1964 | United Kingdom . | |
| 1003887 | 9/1965 | United Kingdom . | |
| 1566080 | 4/1980 | United Kingdom . | |
| 2046664 | 11/1980 | United Kingdom . | |

OTHER PUBLICATIONS

"Der Druckspiegel" (The Printing Mirror) May 1982, pp. 438–439.

German Patent Application, W 2261 XII/15d, Published Jul. 1951.

*Primary Examiner*—J. Reed Fisher

*Attorney, Agent, or Firm*—Dressler, Goldsmith, Shore, Sutker & Milnamow

[57] ABSTRACT

The invention relates to a process and a facility for the operation of a single-color or multi-color printing facility. A first, uniformly designed, idle time occasioning movable machine group of at least one machine unit is used substantially constantly for printing operation. It interacts along a congruent separating line (T), common to all colors, with a second, idle time occasioning machine group of the machine unit, which, for a new run, is exchanged for a further idle time occasioning machine group. The stationary machine groups can be designed differently for the passage of divided or continuous printing material. The separating line runs between plate cylinders of the movable machine group and rubber blanket cylinders of the stationary machine group, which can be components of a rotary sheet-fed or reel-fed printing press. The stationary machine groups are connected by a transport device to a turning device for receiving the movable machine groups. This makes a substantially continuous operation possible for the printing of finite or continuous printing material.

4 Claims, 6 Drawing Sheets

SINGLE-COLOR OR MULTICOLOR OFFSET PRINTER WITH MOVABLE MACHINE GROUPS

This application is a continuation, of application Ser. No. 811,941, filed Dec. 20, 1985.

The invention relates to a process for the operation of a single-color or multi-color printing facility and a facility for execution of this process.

The operation of conventional printing presses, irrespective of whether single-color or multi-color presses, is conditional on the standstill of such machines for their setting up for printing readiness, such as, color changes, printing plate changes, cleaning, etc., because the machines form a self-contained unit. During these standstills, these machines are therefore unproductive, i.e., they occasion idle times. These operations may be particularly time-consuming if, for reasons of accessibility, for example, to a plate cylinder, sub-sets, such as, for example, the inking mechanism, or parts thereof, have to be displaced or tilted within the machine. Naturally, with multicolor printing presses the time expended and personnel requirement are multiplied.

In the case of very small printing facilities, such as, for example, labeling lines, it has been attempted to solve this problem of "idle times" by exchanging individual elements in the manner of cartridges. This is possible with the quality requirements made on such machines, but is in turn time-consuming due to the large number of such small elements.

In the publications cited below, printing presses are described with which it has been attempted to save set-up or idle times. For instance, it is known from German Utility Model 77 18 008 to reduce the time for cleaning or washing the cylinders of the printing mechanisms necessary between each inking and for the necessary removal of the inking device by two side supports for two distributing rollers and one oscillating roller being connected to two sidewalls of a stationary lower part, which receives two ductor rollers, two tension rollers and one form roller and can be connected detachably to a displaceable upper part, in which a printing blanket cylinder and a damping mechanism are additionally provided. The lower parts to be cleaned in each case and the displaceable upper part can be moved jointly aside by means of a transport facility, so that the accessibility of these parts is improved. At least two of the assemblies containing the said sets can be connected interchangeably with the stationary assembly.

From German Offenlegungschrift 3 010 244, a quick-change printing facility is known which, with the aid of carriages displaceable on slide bars and a frame connected thereto, is intended to make a quicker exchange of individual sets possible.

Furthermore, from German patent application W 2261 XII/15d a rotary printing press with inking mechanism arranged in the upper part is known, the rollers of which are borne in a frame, which can be swung relative to the fixed machine frame out of its working position, but remains connected to the fixed machine frame.

In German Auslegeschrift 1 169 959, a multicolor sheet-fed rotary printing press designed as a tandem machine is known, in which a printing mechanism unit is formed by two plate cylinders, which are arranged approximately one over the other and are assigned to these plate cylinders, the two printing mechanisms being movable away from the plate cylinders on oblique tracks in a common frame.

In the periodical "Der Druckspiegel" (The Printing Mirror) 5/1982, page 438/439, a reel-fed rotary printing press is described in which, for exchanging the formats and plates, cartridges contain the plate and rubber blanket cylinders and are automatically moved out of the machine in a turning plate, onto which the plate-rubber blanket combination in the new format is placed and moved into the machine.

In spite of the developments mentioned above as prior art, no one has so far succeeded in eliminating to the greatest extent set-up times from production time in the operation of printing facilities. This disadvantage comes to bear particularly in the case of satellite machines which, in comparison to tandem machines, are substantially more compact, but correspondingly more difficult to gain access to. Furthermore, in the case of the printing facilities mentioned, no possibility is provided for converting them to printing different printing materials, such as, paper, cardboard and sheet metal in the form of boards, sheets, reels, or labels.

The invention is therefore based on the object of being able to implement all jobs occasioning idle times away from a constantly ready-to-operate stationary machine group and, at the same time, make possible the capability of printing virtually all types of printing materials.

The invention achieves this object by using a first machine group of at least one machine unit substantially constantly for printing operation, which machine group interacts along a congruent separating line, common to all colors, with a second, idle time occasioning machine group of the machine unit, which, for a new run, is exchanged for a further, idle time occasioning machine group.

A particularly advantageous development of the invention consists in that the uniformly designed, idle time occasioning, movable machine groups are used in interaction with the at least one differently designed stationary machine group for the passage of divided or continuous printing material.

It is thereby achieved that the idle time occasioning, labor-intensive jobs need be performed exclusively on the sets contained in the movable machine group. Consequently, these jobs demanding idle or set-up times can be performed on the movable machine group when the latter is removed from the stationary machine group and has been exchanged for another movable, newly set-up machine group. The congruent separating line thereby makes possible a special and functional separation of the idle time occasioning areas from the stationary areas ready to produce without intervention of the staff. In particular, the ink and water carrying elements, such as, plate cylinders, inking mechanisms, damping mechanisms, etc., can be designed for single-color or multi-color arrangement as an organic unit which can be designed as movable exchange system, so that a movable machine group away from the stationary, producing machine group can be newly set up in each case.

Even more advantageously, the process according to the invention can be used when the movable exchange system consisting of two systems has a third one added to it. In this case, two stationary machine groups can then alternatively interact with one movable machine group each, while the third movable machine group can be set up for its next deployment.

The process according to the invention is extremely productive in printing from a reel, for example, reel to reel, reel to sheet or folding machine, because extraordinarily high printing capacities are achieveable by this method, so that idle time occasioning work operations cause that much higher forfeited production and losses. By analogy, with appropriate dimensioning, the field of label manufacture can also be covered by the invention.

A facility for implementing the process according to the invention comprises at least one machine unit which is subdivided by a congruent separating line, common to all colors, into a stationary, constantly ready-to-operate machine group and into a movable, idle time occasioning machine group, the movable machine group being exchangeable for a further movable, idle time occasioning machine group.

In this arrangement, the separating line can be arranged between at least one plate cylinder of the movable machine group and a neighboring cylinder of the movable machine group and a neighboring cylinder coming into contact with the printing material. Consequently, printing can be carried out by indirect letterpress printing or offset printing.

The invention brings with it a particular advantage in conjunction with a facility for offset printing of the satellite type wherein, according to the invention, the stationary, constantly ready-to-produce machine group is provided with at least one rubber blanket cylinder and a single back pressure cylinder, as well as feed and delivery for the printing material, and the movable, idle time occasioning machine group has at least one plate cylinder with associated inking mechanism and damping mechanism, the separating line running between the plate cylinder(s) in the movable machine group and the rubber blanket cylinder(s) in the stationary machine group, the stationary machine group is, optionally, component of a rotary sheet-fed printing press or rotary reel-fed printing press, and a number, corresponding to the number n, of stationary, constantly ready-to-operate machine groups is assigned a number, corresponding to the number n+1, of movable, idle time occasioning machine groups. A reel-fed rotary offset printing press of the satellite type designed in this way makes possible, on the one hand, an independent operability of the stationary and of the movable machine groups and direct accessibility of the plate cylinders with the associated inking and damping mechanisms on the one hand, and of the rubber blanket cylinders and of the back pressure cylinder on the other hand.

In the case of the satellite machine, the separating line advantageously runs substantially vertically between the stationary machine group and the movable machine group. This achieves an optimum separation and accessibility of the idle time occasioning sets located in the movable machine group for the constantly ready-to-produce sets in the stationary machine group.

Finally, another advantageous design of the invention consists in that a transport device for the movable machine groups extends between at least two stationary machine groups, which transport device is provided with a turning device for the simultaneous reception of at least two machine groups. Owing to the fact that at least two stationary, constantly ready-to-operate machine groups are provided, two movable, idle time occasioning machine groups can be connected simultaneously to the two stationary machine groups and used for production, so that a third movable, idle time occasioning machine group does not have to wait for a deployment after its maintenance or cleaning until renewed exchange with the movable machine group just exchanged, but can be exchanged for one of two movable machine groups. This makes possible an optimum utilization of the production capacity of the facility and a saving in idle times of the standby machine group. As the congruent separating line is the same for movable machine groups designed as a rotary sheet-fed printing press as for movable machine groups designed as a rotary reel-fed press, a thus far unobtainable versatility of the printing unit according to the invention is achieved without the movable machine groups requiring a conversion to adapt them to the printing of sheets or reels.

The invention is described in more detail below with reference to the diagrammatic representation of exemplary embodiments, in which.

Figure 1:
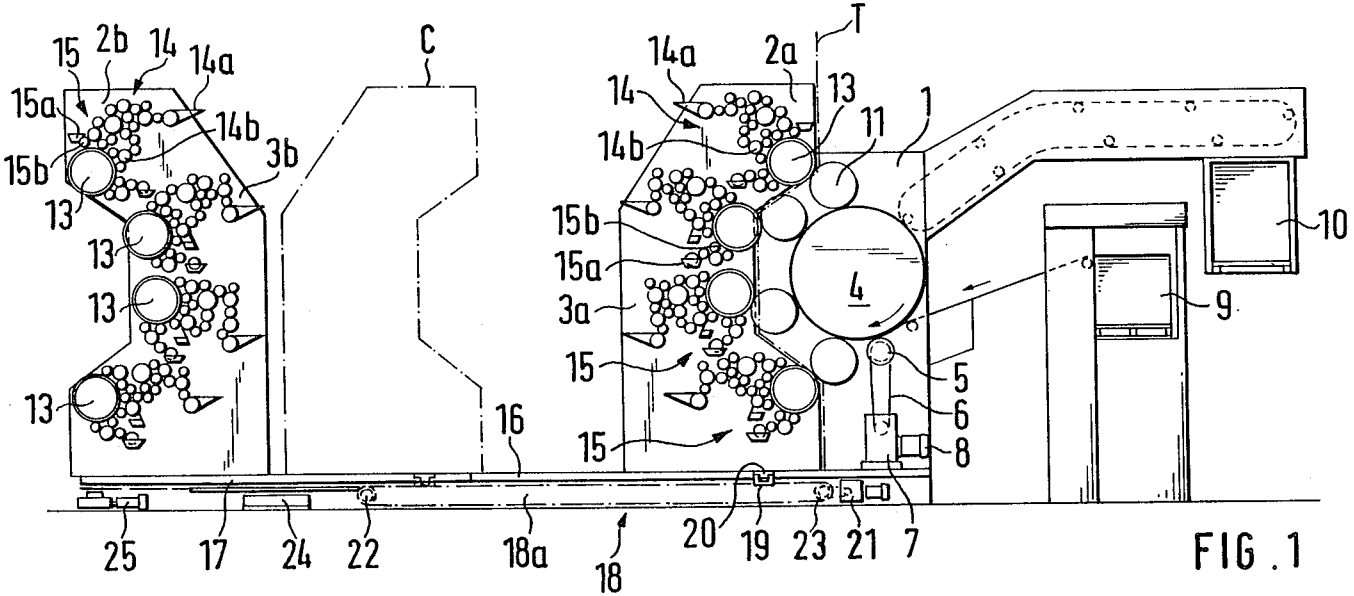
FIG. 1 shows a view of a sheet-fed rotary printing press of the satellite type with a stationary, permanently ready-to-operate machine group and two movable, idle time occasioning machine groups and turning device.

FIG. 1 shows an offset printing facility which is designed as a sheet-fed rotary printing press of the satellite type. The sheet-fed rotary printing press consists of a stationary, permanently ready-to-operate machine group 1 and two identical, movable, idle time occasioning machine groups *2a*, *2b* with machine frame *3a*, *3b*. The movable machine group *2a* is connected, ready to operate, with the stationary machine group 1, the machine groups 1 and *2a* forming a congruent separating line T, common to all colors, which runs substantially vertically.

The stationary machine group 1 consists of a back pressure cylinder 4, with which a driving pinion 5 intermeshes, which is connected via a chain drive 6 and a gear 7 to a drive motor 8.

The stationary machine group 1 is, furthermore, assigned a feed 9 and a delivery 10 for the printing material in sheet or board form on the side facing away from the side of the movable machine group *2a*. On the side of the back pressure cylinder 4 facing the movable machine group *2a* are arranged four rubber blanket cylinders 11 which are in contact with the back pressure cylinder 4 over about half of its circumference. The rubber blanket cylinders 11 are rotatably borne in a machine frame 12 of the stationary machine group 1 and have a substantially smaller diameter than the back pressure cylinder 4. It is thus apparent that the stationary machine group 1 is constantly ready to operate.

In the machine frame *3a* of the movable machine group *2a*, four plate cylinders 13 are rotatably borne along the separating line T, which plate cylinders are dampened and inked for each print. The plate cylinders 13 apply the ink, with part of the dampness, mirror-invertedly onto the rubber blanket cylinders 11, which pass on the ink to the printing material and are likewise arranged along the separating line T.

For this purpose, the plate cylinders 13 in the movable machine group 2a are in each case assigned an inking mechanism 14 and a damping mechanism 15 with an ink fountain 14a and wetting fountain 15a, respectively, and a plurality of inking and damping rollers 14b and 15b.

Owing to the substantially vertically running, congruent separating line T between the plate cylinders 13 of the movable machine group 2a and the rubber blanket cylinders 11 of the stationary machine group 1, the plate cylinders 13 and the associated inking mechanisms 14, 14a and damping mechanisms 15, 15a are consequently accessible directly for maintenance and exchange purposes, just as the rubber blanket cylinders 11 and the back pressure cylinder 4 are, when the movable machine group 2a is separated from the stationary machine group 1.

The separating line T made between the plate cylinders 13 and the rubber blanket cylinders 11 thus makes a neat separation possible between the sets to be maintained by staff arranged in the movable machine group 2a and the maintenance-free sets arranged in the stationary machine group 1 which, whenever they need any maintenance, are automatically maintained, for example, washed or cleaned. Positioning the separating line along the plate cylinders and rubber blanket cylinders makes these directly accessible in each case and their associated damping and inking mechanisms can be reached for exchange or cleaning purposes.

The movable machine group 2b is identical to the movable machine group 2a, in other words, likewise provided with four plate cylinder 13 which are assigned inking mechanisms 15 in the same way.

Figure 6:
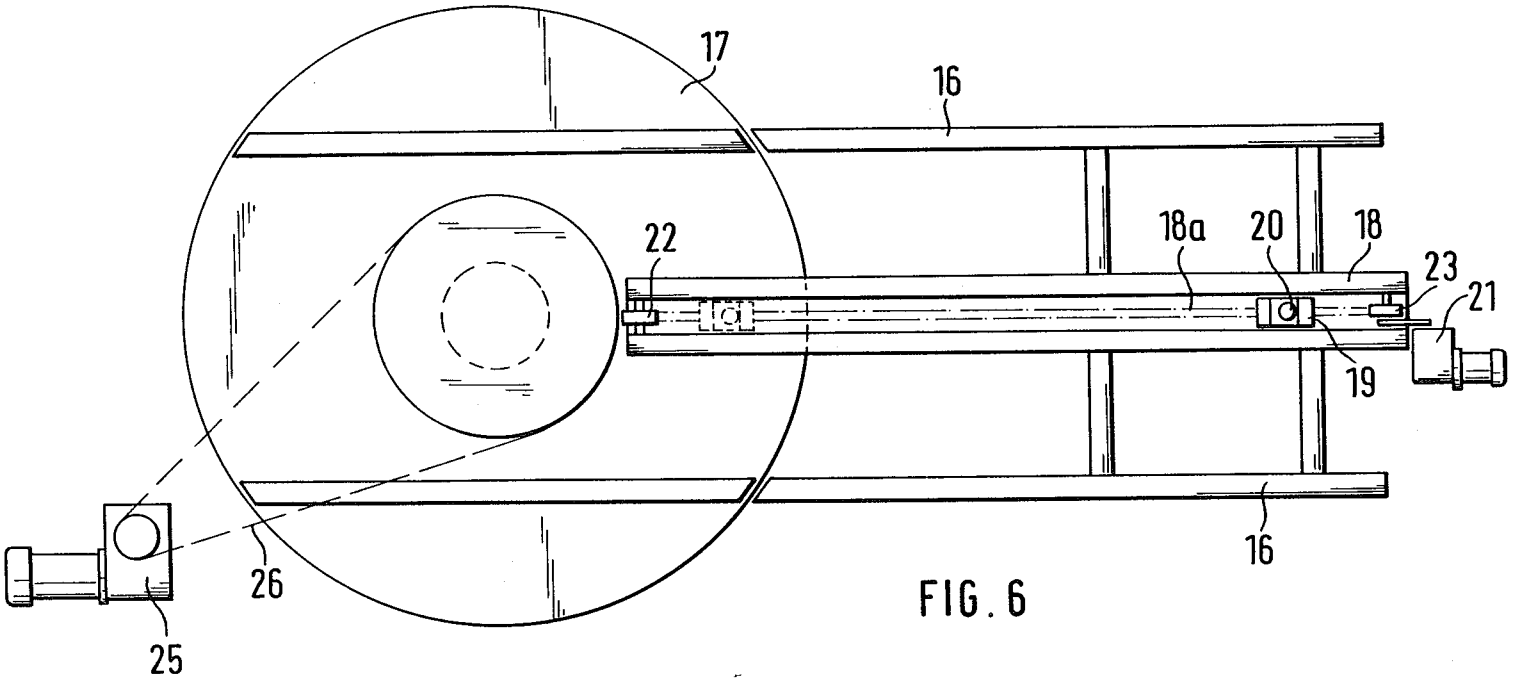
FIG. 6 shows a plan view of the turning device in FIG. 1.

According to FIGS. 1 and 6, the movable machine group 2a is exchangeable, by means of a transport device 18, for the movable machine group 2b, to limit the standstill of production to a minimum time and to be able to save set-up time for the exchanged machine goup 2a in favor of production time. For this purpose, the movable machine group 2a is arranged on rails 16 which lead to a turntable 17, on which the movable machine group 2b stands.

Parallel to the rails 16, in the vertical plane, is arranged a chain drive 18a, the chain of which is provided with dogs 19 which can be coupled in a suitable way to corresponding coupling elements 20 of the movable machine groups 2a, 2b. The chain drive 18 can be driven by a drive system 21. Although a single chain drive 18a is provided between the transport rails 16 for the transport of the movable machine groups, it is also possible to arrange one each of two such chain drives 18a in each case in the region of one rail 16. The continuous transport chains of the chain drives 18a are led in the usual way around sprockets 22, 23 of which sprocket 23 is connected in a suitable way to the drive 21.

Instead of chain drives, other mechanical or else hydraulic, pneumatic and electrical drives or combinations of these can be used.

At the end of the transport device 18 facing away from the stationary machine group 1a is located in the turntable 17, which is rotatable about a vertical axis 24 by means of a drive 25. The drive forces of the drive 25 on the turntable 17 can be transferred, for example, by means of a chain drive 26.

As is apparent, the turntable 17 is dimensioned large enough to provide space on it for at least the two movable machine groups 2a, 2b. Consequently, within the scope of a fixed working cycle, the machine groups 2a can be conveyed by means of the transport device 18 on the rails 16 to the turntable 17 in the position C illustrated by dot-dashed lines. Subsequently, the turntable is turned through 180 degrees by means of the drive 25 in order that the machine group 2b can be moved by means of the transport device 18 on the rails into the operating position at the stationary machine group 1a and can be mechanically coupled to the latter along the congruent separating line T. Consequently, the exchanged machine group 2a then assumes the position of the machine group 2b shown in FIG. 1 and is accessible on all sides for maintenance jobs, while at the same time the sheet-fed rotary press, which consists of the stationary machine group 1a and the movable machine group 2b, can continue to produce virtually without interruption.

In FIG. 1, the facility was explained with reference to only one stationary machine group 1 and two movable machine groups 2a, 2b. However, the invention also provides for reducing idle times which arise on account of the movable machine group 2b located on the turntable 17 having to wait for its renewed exchange for the other movable machine group 2a after its maintenance and preparation for the next deployment. This waiting time can be avoided if the production cycle is designed such that the movable machine part which is waiting and prepared for its next production deployment is fed to a further stationary machine group and connected to it for common deployment.

Figure 2:
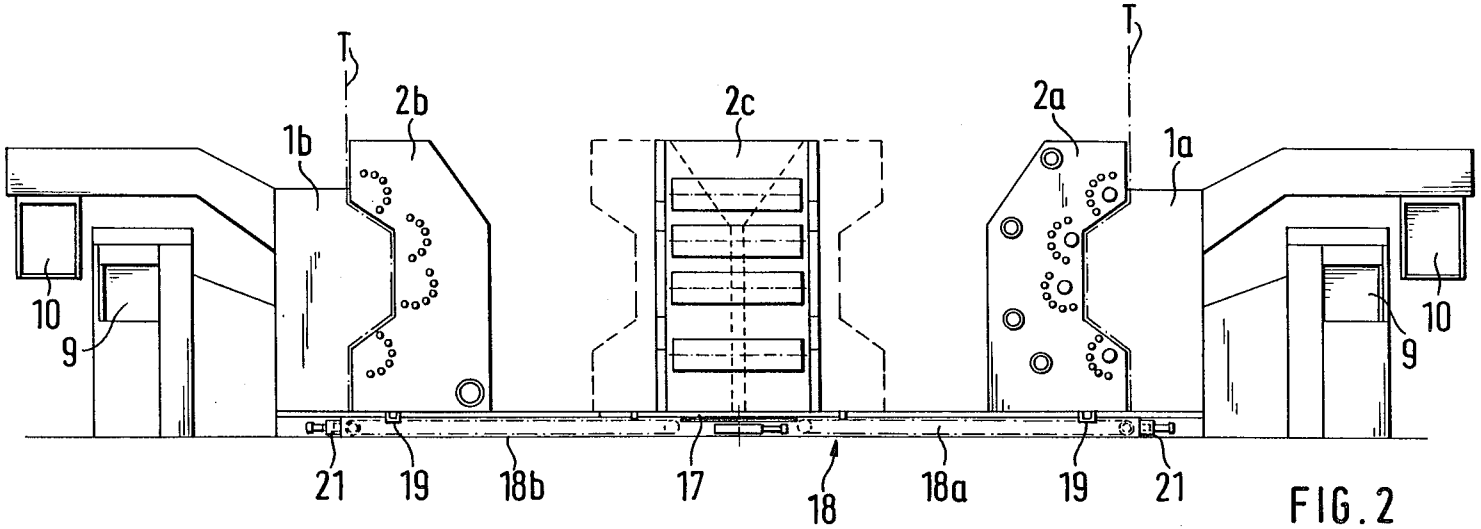
FIG. 2 shows a view of two stationary machine groups, spaced oppositely apart, which with two of three movable machine groups form two sheet-fed rotary printing presses of the satellite type.
Figure 3:
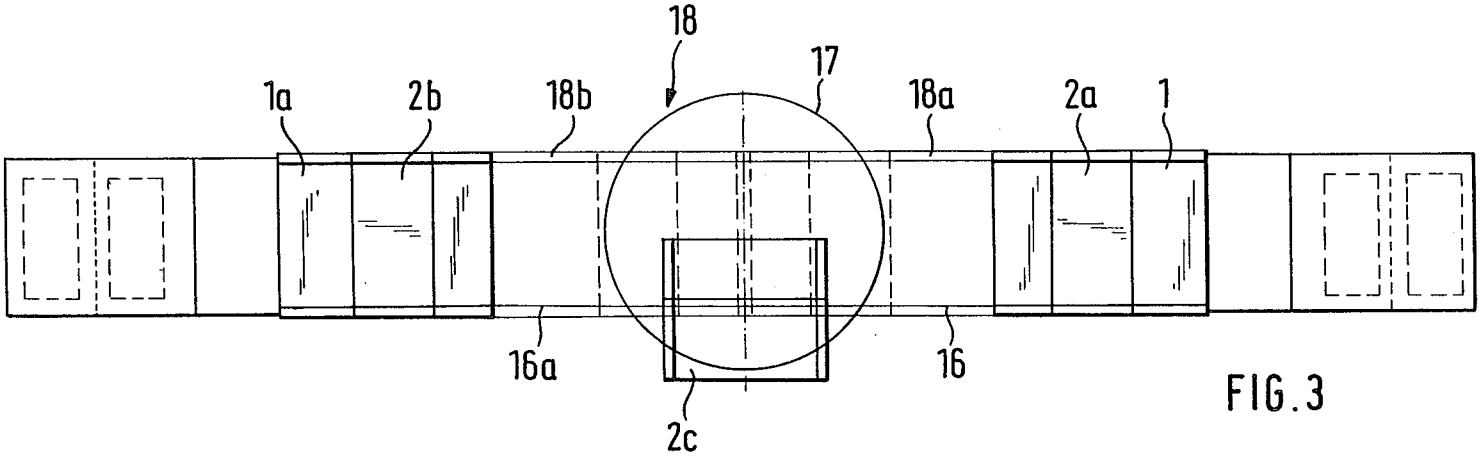
FIG. 3 shows a plan view corresponding to FIG. 2.

According to FIGS. 2 and 3, this further saving of set-up times is provided by a stationary machine group 1a having a second, identical stationary machine group 1b arranged spaced opposite it. Provided in the middle between the two stationary machine groups 1a, 1b is the turntable 17, to which two chain drives 18a, 18b lead in each case. In the case of this example, as is apparent in particular for FIG. 3, the movable machine groups 2a, 2b are connected to the stationary machine groups 1a, 1b along the common separating line T for deployment, while a third movable machine group 2c is arranged on the turntable 17 in a positioned turned through 90 degrees relative to the two other machine groups 2a, 2b and awaits exchange with one of the other movable machine groups 2a, 2b.

Figure 4:
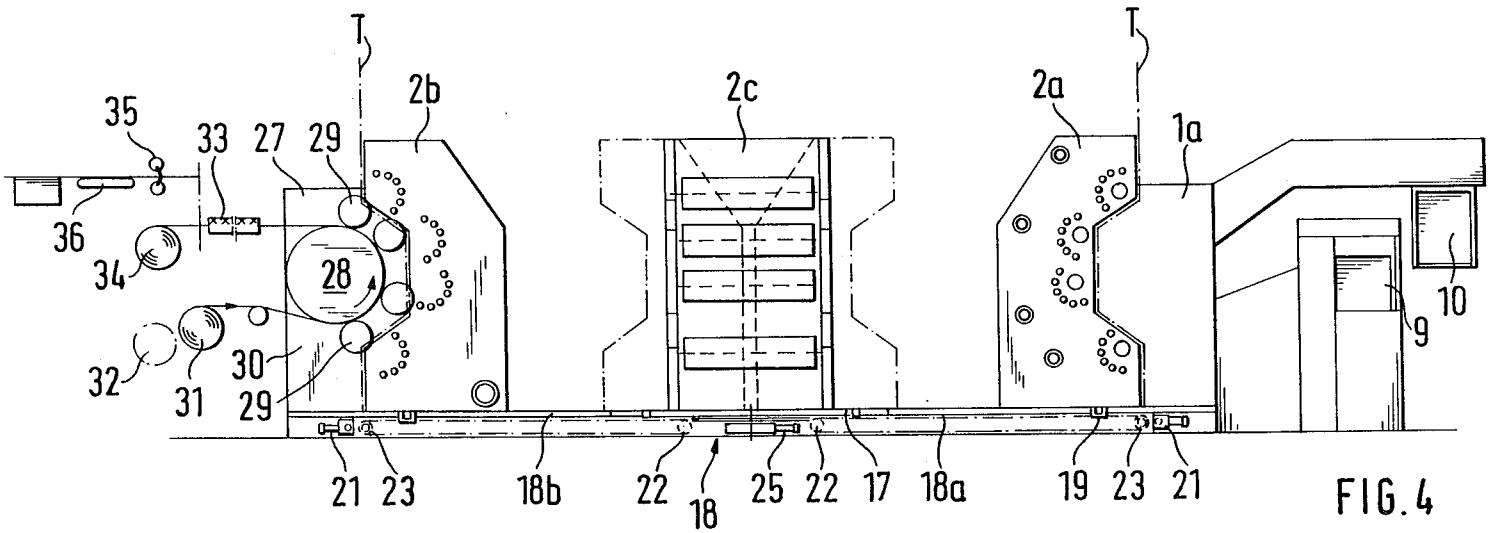
FIG. 4 shows a view of the stationary machine groups of a sheet-fed rotary printing press and of a reel-fed rotary printing press with three exchangeable, identical, idle time occasioning machine groups.

FIG. 4 illustrates that the movable machine groups 2a, 2b, which are identically designed, can be connected operationally as desired to the stationary machine group 1a of a sheet-fed rotary printing press or the stationary machine group 27 of a reel-fed rotary printing press. At the same time, as in the example according to FIGS. 2 and 3, the two printing presses are in turn connected to each other by the transport device 18 with two chain drives 18a, 18b and an interposed turntable 17 for the third movable machine group 2c.

The stationary machine group 27 of the reel-fed rotary printing press is likewise of satellite design and has a back pressure cylinder 28 about which four rubber blanket cylinders 29 are arranged and rotatably borne in the machine frame 30. In the feed, 31 denotes a roller for the printing material, just off of which roller is a standby roller 32. The printing material is fed in the delivery through a drying device 33 optionally to a roller 34 or a cross cutter 35 and a flat delivery 36. In this context, it is obviously conceivable to arrange other stationary machine groups for sheet-fed and/or reel-fed rotary printing at right angles to the machine units shown here of a sheet-fed rotary printing press or reel-fed rotary printing press.

Figure 5:
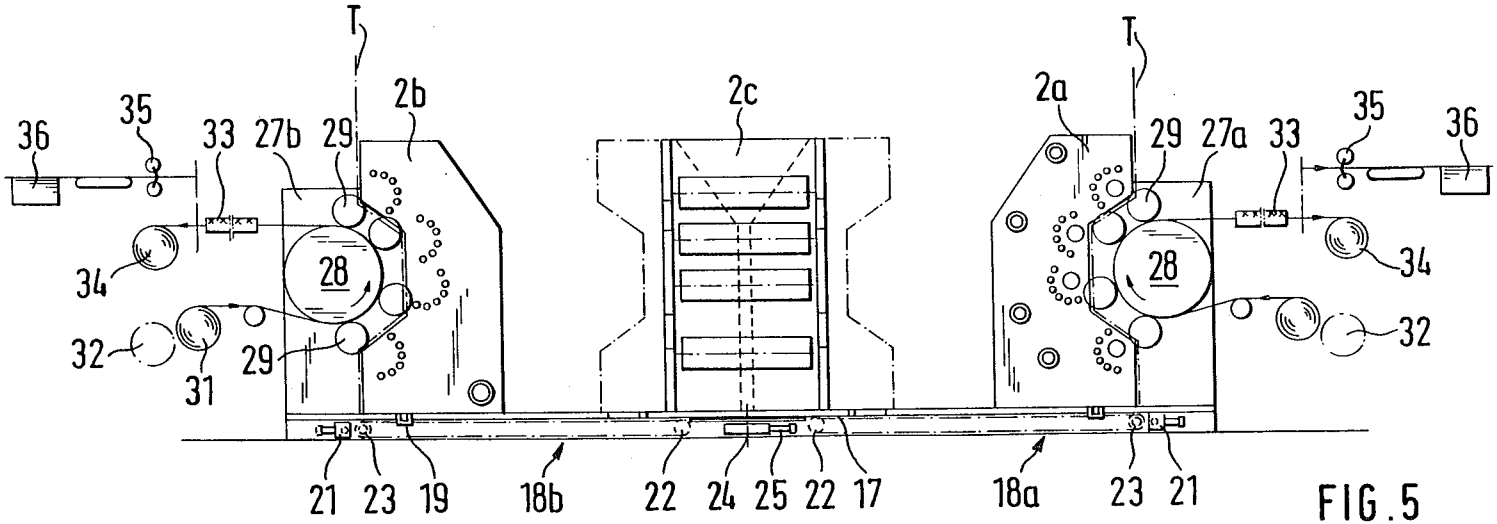
FIG. 5 shows a view of two machine units of the reel-fed rotary printing press type, consisting of one stationary machine group each, as well as three identical movable, idle time occasioning machine groups.

Thus, the embodiments described also give rise to the possibility shown in FIG. 5 of assigning the movable machine groups 2*a*, 2*b*, 2*c* in each case to a stationary machine group 27*a* and 27*b*, respectively, of two reel-fed rotary printing presses to establish two identical machine units which are designed corresponding to the stationary machine group 27 described in FIG. 4, so that their parts are provided with the same reference numbers and a renewed description of details can be dispensed with. Consequently, here too, the third movable machine group 2*c* is available on the turntable 17 for exchanging for one or other of the two movable machine groups 2*a*, 2*b* which are in each case being deployed. Naturally, here too, further stationary machine groups can be arranged radially around the turntable and connected into several machine units exchangeably with movable machine groups by the transport device 18*a*, 18*b*.

It thus arises clearly from the above description that the invention makes possible an optimum, because virtually continuous, utilization of the machine capacities available, irrespective of whether a sheet-fed or reel-fed rotary printing press is concerned, a particularly advantageous solution having been found for machines of the satellite type, the maintenance of which is impossible considering the compact arrangement of their individual sets. Furthermore, various finite and continuous printing materials can be printed, such as, paper or sheet metal.

What is claimed is:

1. A single-color or multi-color offset printer of the satellite type for printing divided sheet or continuous web printing material, comprising in combination:

at least two machine units, each of said units being separable along a single operational line into two separable sections, one section being a stationary machine group and the other section being a movable machine group separable from said stationary group so as to form first and second movable machine groups located between oppositely spaced first and second stationary machine groups;

each of said stationary machine groups being provided with at least one rubber blanket cylinder and a respective single back pressure cylinder and further including means for feeding and delivering the printing material;

each of said movable machine groups having at least one plate cylinder with associated inking mechanism and damping mechanism;

each of said machine units being of a satellite design whereby each stationary machine group has means for mounting one or more blanket cylinders about its respective said single back pressure cylinder, and each movable machine group has means for mounting one or more plate cylinders for cooperable engagement with respective ones of said one or more blanket cylinders whereby each machine unit may selectively perform single-color or multi-color printing, said operational line running between the said at least one plate cylinder in each movable machine group and the at least one rubber blanket cylinder in each stationary machine group;

at least one additional movable machine group, means for interchanging each of said first and second movable machine groups with said additional movable machine group;

the number of said movable machine groups being one more than the number of said stationary machine groups;

said means for feeding and delivering including one of said stationary machine groups having means for feeding and delivering divided sheet printing material, the other of said stationary machine groups having means for feeding and delivering continuous web printing material;

said means for interchanging including a transport device extending between said stationary machine groups, said transport device being provided with a turntable for the simultaneous reception of at least two of said movable machine groups.

2. Printer according to claim 1, wherein said feeding and delivering means for one of said stationary machine units comprises radially around said metal sheets.

3. Printer according to claim 1, wherein the stationary machine groups are arranged radially around said turntable.

4. Printer according to claim 1, wherein said stationary machine groups and said movable machine groups are independently operable.

* * * * *

UNITED STATES PATENT AND TRADEMARK OFFICE

CERTIFICATE OF CORRECTION

PATENT NO. : 4,774,883

DATED : October 4, 1988

INVENTOR(S) : Udo Mailänder

It is certified that error appears in the above-identified patent and that said Letters Patent is hereby corrected as shown below:

Claim 2, line 3, cancel "radially around said" and insert --a feed and delivery for--.

Signed and Sealed this

Twenty-first Day of March, 1989

*Attest:*

*Attesting Officer*

DONALD J. QUIGG

*Commissioner of Patents and Trademarks*